US007129776B2

(12) United States Patent
Watanabe

(10) Patent No.: US 7,129,776 B2
(45) Date of Patent: Oct. 31, 2006

(54) BIAS VOLTAGE GENERATOR CIRCUIT

(75) Inventor: Shinichi Watanabe, Tokyo (JP)

(73) Assignee: Seiko NPC Corporation (JP)

( * ) Notice: Subject to any disclaimer, the term of this patent is extended or adjusted under 35 U.S.C. 154(b) by 141 days.

(21) Appl. No.: 10/999,179

(22) Filed: Nov. 29, 2004

(65) Prior Publication Data

US 2005/0116766 A1 Jun. 2, 2005

(30) Foreign Application Priority Data

Dec. 1, 2003 (JP) ..... 2003/402176

(51) Int. Cl.
*G05F 1/10* (2006.01)

(52) U.S. Cl. ..... 327/543

(58) Field of Classification Search ..... 323/315, 323/316; 327/530, 534, 535, 537, 538, 540, 327/541, 543

See application file for complete search history.

(56) References Cited

FOREIGN PATENT DOCUMENTS

JP 64042717 2/1989

*Primary Examiner*—Jeffrey Zweizig
(74) *Attorney, Agent, or Firm*—Adams & Wilks

(57) ABSTRACT

A bias voltage generator circuit capable of keeping a constant electric current consumption ($I_0$) and supplying bias voltages ($V_1$, $V_2$) respectively kept at constant values relative to its source voltage ($V_{DD}$) and GND potential even when $V_{DD}$ fluctuates. The circuit includes: three p-channel transistors connected in a current mirror, each having a source connected to source voltage; and four n-channel transistors, each having a source connected to GND. Bias voltages $V_1$ and $V_2$ are in a relation such that they control each other. Concretely, the $V_1$ potential starting to rise causes the $V_2$ potential to start to decrease, and the $V_1$ potential starting to decrease causes the $V_2$ potential to start to rise. The circuit has the property of making the circuit current fixed regardless of $V_{DD}$. Even when $V_{DD}$ fluctuates, $I_0$ is constant and $V_1$ and $V_2$ each produce a fixed potential.

6 Claims, 5 Drawing Sheets

BIAS VOLTAGE GENERATOR CIRCUIT

BACKGROUND OF THE INVENTION

1. Field of the Invention

The present invention relates to a bias voltage generator circuit for an amplifier. More specifically, it relates to a bias voltage generator circuit capable of keeping a bias voltage constant.

2. Description of the Related Art

Conventionally, what has been known as a circuit arrangement for keeping a circuit current constant with a fixed bias voltage even when a source voltage fluctuates is an arrangement including: a first p-channel field effect having a source connected to a power source; a first n-channel field effect transistor having a drain connected to a drain of the first p-channel field effect transistor; a second p-channel field effect transistor having a source connected to the power source and a gate connected to a gate of the first p-channel field effect transistor and the drain thereof; and a second n-channel field effect transistor having a drain connected to a gate of the first n-channel field effect transistor and through a resistor to a drain of the second p-channel field effect transistor, the second n-channel field effect transistor having a gate connected to the drain of the second p-channel field effect transistor. Also, as shown in FIG. 8, there has been known an arrangement including: a first p-channel field effect transistor MP1000 having a source connected to a power source; a first n-channel field effect transistor MN1000 having a gate and a drain, both connected to a drain of the first p-channel field effect transistor; a second p-channel field effect transistor MP2000 having a source connected to the power source and a drain connected to a gate of the first p-channel field effect transistor MP1000; and a second n-channel field effect transistor MN2000 having a drain connected to a gate of the second p-channel field effect transistor MP2000 and through a resistor R1000 to the drain of the second p-channel field effect transistor MP2000, the second n-channel field effect transistor MN2000 having a gate connected to the gate of the first n-channel field effect transistor MN1000. (See Japanese Unexamined Patent Application Publication No. JP-A-64-42717.)

This type of circuit commonly has a tendency to depend on the size and characteristics of transistors in setting voltage and flatness. Even with the above conventional example, the flatness is increased, but there is still a tendency to depend on a source voltage under the actual characteristics of transistors. Therefore, there has been a problem such that an increase in source voltage increases the bias voltage and the circuit current. The invention has as its object to provide a bias voltage generator circuit, which can solve such conventional problem and keep a constant electric current consumption and supply a bias voltage kept at a constant value relative to its source voltage and a voltage kept at a constant value relative to the ground (GND) potential even when the source voltage fluctuates.

SUMMARY OF THE INVENTION

In order to achieve the object, the bias voltage generator circuit according to Claim 1 of the invention is one for supplying a constant voltage comprising, a first p-channel field effect transistor having a source connected to a power source potential and a drain connected to a first resistor, a second p-channel field effect transistor having a source connected to the power source potential and a gate connected to a gate of said first p-channel field effect transistor, a third p-channel field effect transistor having a source connected to the power source potential, a gate and a drain connected to the gate, said first and second p-channel field effect transistors connected, in a current mirror, to a potential at a connecting portion of the gate and drain of said third p-channel field effect transistor, a first n-channel field effect transistor having a source connected to a ground (GND), a gate, and a drain, the gate and drain connected through a second resistor to one end of the first resistor opposite the other end thereof connected to said first p-channel field effect transistor, a second n-channel field effect transistor having a source connected to GND and a drain connected to a node of the first and second resistors through third and fourth resistors connected in series, a third n-channel field effect transistor having a source connected to GND, a drain, and a gate, the drain and gate connected to a gate of said second n-channel field effect transistor and to a drain of said second p-channel field effect transistor; and a fourth n-channel field effect transistor having a source connected to GND, a gate connected to a node of the third and fourth resistors, and a drain connected to the drain of said third p-channel field effect transistor.

Likewise, in order to achieve the object, the bias voltage generator circuit according to Claim 4 of the invention is one for supplying a constant voltage comprising, a first n-channel field effect transistor having a source connected to GND and a drain connected to a first resistor, a second n-channel field effect transistor having a source connected to GND and a gate connected to a gate of said first n-channel field effect transistor, a third n-channel field effect transistor having a source connected to GND, a gate and a drain connected to the gate, said first and second n-channel field effect transistors connected, in a current mirror, to a potential at a connecting portion of the gate and drain of said third n-channel field effect transistor, a first p-channel field effect transistor having a source connected to a power source potential, a gate, and a drain, the gate and drain connected through a second resistor to one end of the first resistor opposite the other end thereof connected to said first n-channel field effect transistor, a second p-channel field effect transistor having a source connected to the power source potential and a drain connected to a node of the first and second resistors through third and fourth resistors connected in series, a third p-channel field effect transistor having a source connected to the power source potential, a drain, and a gate, the drain and gate connected to a gate of said second p-channel field effect transistor and to a drain of said second n-channel field effect transistor; and a fourth p-channel field effect transistor having a source connected to the power source potential, a gate connected to a node of the third and fourth resistors, and a drain connected to the drain of said third n-channel field effect transistor.

A bias voltage generator circuit according to the invention can produce an advantage that it can keep a circuit current in the bias voltage generator circuit constant over a wide source voltage range to supply a constant voltage relative to the source voltages and/or the GND potential.

DESCRIPTION OF THE PREFERRED EMBODIMENTS

Figure 1:
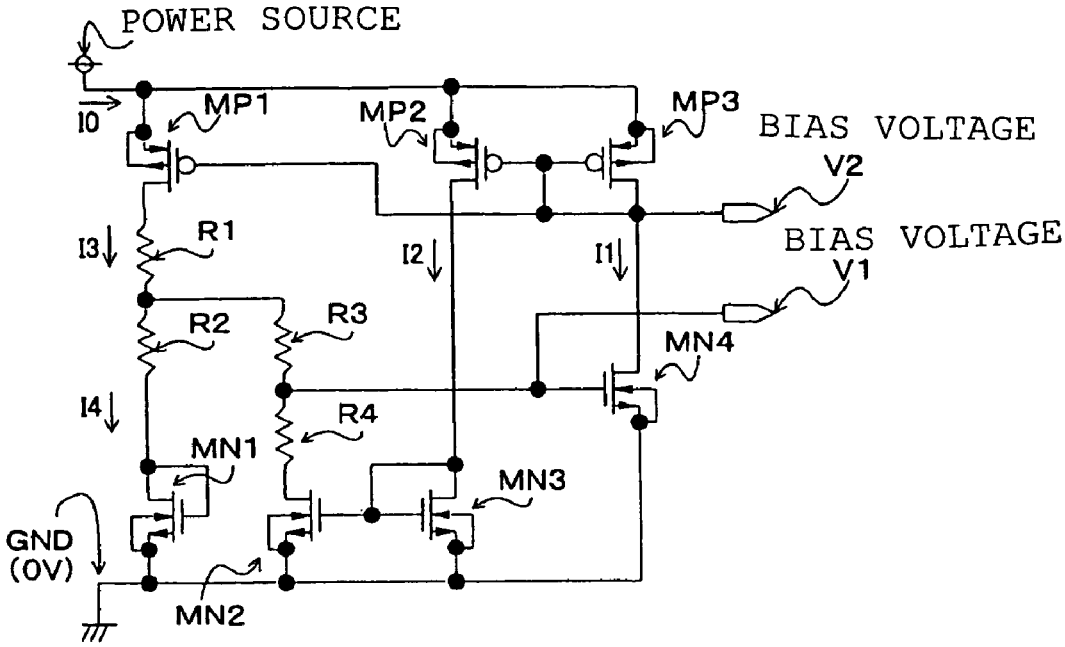
FIG. 1 is a circuit diagram showing a bias voltage generator circuit according to a first embodiment of the invention.

Preferred embodiments of the invention will be described below based on the accompanying drawings. First, an arrangement of the first embodiment will be described based on the block diagram of FIG. 1. As shown in FIG. 1, the bias generator circuit includes first, second and third p-channel field effect transistors MP1, MP2, and MP3 (hereinafter referred to as transistors MP1, MP2, and MP3, respectively), each having a source connected to a power source potential, wherein the transistor MP1 has a drain connected to a resistor R1, and the transistors MP1 and MP2 are connected, in a current mirror, to a potential at a connecting portion of a gate and drain of the transistor MP3.

The transistor MP2 has a drain connected to a drain and a gate of a third n-channel field effect transistor MN3 to be described later. Also, the drain of the transistor MP3 is connected to a drain of a fourth n-channel field effect transistor MN4 to be described later.

On the other hand, the bias generator circuit includes first, second, third and fourth n-channel field effect transistors MN1, MN2, MN3, and MN4 (hereinafter referred to as transistors MN1, MN2, MN3, and MN4, respectively), each having a source connected to GND, wherein the transistor MN1 has a gate and a drain, both connected through a resistor R2 to one end of the resistor R1 opposite the other end thereof connected to the transistor MP1.

The transistor MN2 has a drain connected to a node of the resistors R2 and R1 through resistors R3 and R4 connected in series and a gate connected to the drain and gate of the transistor MN3. Further, the transistor MN4 has a gate connected to a node of the resistors R3 and R4 and the drain connected to the drain of the transistor MP3.

The embodiment is arranged as described above and as such, a voltage at the gate or source of the transistor MN4 determines a drain current thereof. The drain current coincides with a drain current of the transistor MP3, determining the gate or source voltage of the transistor MP3. The gate or source voltage of the transistor MP3 makes the gate or source voltage of the transistor MP2, determining the drain current of the transistor MP2.

The drain current of the transistor MP2 coincides with the drain current of the transistor MN3, determining the gate or source voltage of the transistor MN3. The drain current of the transistor MN3 determines the gate or source voltage of the transistor MN2 and the drain current thereof. The gate or source voltage of the transistor MP3 determines the gate or source voltage of the transistor MP1 and the drain current of the transistor MP1 determines the drain current of the transistor MN2. The drain current of the transistor MP1 is equal to a sum of the drain currents of the transistors MN1 and MN2.

Here, the current dividing ratio of the transistors MN1 and MN2 depends on the sizes of the transistors and the resistances R1, R2, R3 and R4. By setting the sizes and resistances at proper values, the transistor MN4 can automatically controlled to desired gate voltage and thus the drain current of the transistor MN4 can be made constant. Therefore, $V_1$ is always at a constant voltage relative to GND and $V_2$ is always at a constant voltage relative to the power source voltage. Also, the current consumed by the bias voltage generator circuit is normally constant.

In this way, the following are made possible: to supply a constant voltage $V_1$ relative to GND potential from the side of the gate of the transistor MN4 over a wide source voltage range in order to generate a gate-driving voltage for a transistor used for current setting; and to supply a constant voltage $V_2$ relative to the source voltage from the side of the drain of the transistor MP3 over a wide source voltage range.

Now, the relation between circuit voltages and currents in the above-described embodiment can be presented by the following expressions:

$$\beta_0 = \mu_0 \cdot C_{ox} = \mu_0 \cdot \frac{\varepsilon_{0x}}{t_{ox}}$$

$$\begin{aligned} I_1 &= \frac{1}{2}\beta_0 \frac{W_{MP3}(V_2 - V_{DD} - V_{thp})^2}{L_{MP3}} \\ &= \frac{1}{2}\beta_0 \frac{W_{MN4}(V_1 - V_{thn})^2}{L_{MN4}} \\ &= \frac{L_{MP1} W_{MP3} I_3}{W_{MP1} L_{MP3}} \\ &= \frac{1}{2}\beta_0 \frac{W_{MN1} L_{MP1} W_{MP3} L_{MN2} W_{MN3}(V_{MN1G} - 2V_{MN1G}V_{thn} + V_{thn}^2)}{L_{MN1}(W_{MP1} L_{MP3} L_{MN2} W_{MN3} - W_{MN2} L_{MN3} L_{MP1} W_{MP3})} \end{aligned}$$

$$I_3 = I_4 + I_5$$

$$\begin{aligned} I_4 &= \frac{1}{2}\beta_0 \frac{W_{MN1}(V_{MN1G} - V_{thn})^2}{I_{MN1}} R_1 I_4 + V_{MNG} \\ &= I_5 R_2 + V_1 \end{aligned}$$

$$1_3 = \frac{W_{MP1} L_{MP3} I_1}{L_{MP1} W_{MP3}}$$

$$V_1 = \frac{1}{2}\beta_0 \frac{\beta_0 2W_{MN4} + V_{thn} + 2\sqrt{2}\sqrt{\beta_0 W_{MN1} L_{MN1} I_1}}{\beta_0 W_{MN1}}$$

$$\begin{aligned} V_2 &= \frac{1}{2}\beta_0 \frac{\beta_0 2W_{MN3} V_{thp} + 2\beta_0 W_{MP3} V_{DD} - 2\sqrt{2}\sqrt{\beta_0 W_{MP3} L_{MP3} I_1}}{\beta_0 W_{MN1}} \\ &= \frac{1}{2} \frac{2\sqrt{\begin{array}{c} W_{MP3} L_{MN4} W_{MN4} L_{MP3} V_1^2 + W_{MP3} L_{MN4} W_{MN4} L_{MP3} V_{thn}^2 - \\ 2W_{MP3} L_{MN4} W_{MN4} L_{MP5} V_1 V_{thn} \end{array}} + 2W_{MP3} L_{MN4} V_{DD} + 2W_{MP3} L_{MN4} V_{thp} -}{W_{MP3} L_{MN4}} \end{aligned}$$

$$V_{MN1G} = \frac{1}{2}\beta_0 \frac{\beta_0 2W_{MN1} V_{thn} + 2\sqrt{2}\sqrt{\beta_0 W_{MN1} L_{MN1} I_4}}{\beta_0 W_{MN1}}$$

$$= \frac{1}{2} \frac{2\sqrt{\begin{array}{c} \beta_0 W_{MN1} W_{MP3} L_{MP5} L_{MN2}^2 W_{MN3}^2 I_1 L_{MN1} - \\ 2\beta_0 W_{MN1} W_{MP3}^2 L_{MP3}^2 L_{MN2} W_{MN3} I_1 L_{MN1} W_{MN2} L_{MN3} \end{array}} + \beta_0 W_{MN1} W_{MP3} L_{MP3} L_{MN2} W_{MN3} V_{thn} +}{\beta_0 W_{MN1} W_{MP3} L_{MP3} L_{MN2} W_{MN3}}$$

-continued $$V_1 = \frac{1}{2}\frac{2W_{MN4}L_{MP3}V_{thn} + 2\sqrt{\begin{array}{l}2W_{MN4}L_{MP3}L_{MN4}V_{DD}V_{thp} + \\ W_{MN4}L_{MP3}W_{MP3}L_{MN4}V_{thp}^2 + \\ W_{MN4}L_{MP3}W_{MP3}L_{MN4}V_{DD}^2\end{array}}}{W_{MN4}L_{MP3}}$$

where $\mu_0$: a drift speed of carriers;

$\epsilon_{ox}$: a gate oxide film dielectric constant;

$t_{ox}$: a gate oxide film thickness;

$V_{thp}$: a p-channel transistor threshold voltage;

$V_{thn}$: an n-channel transistor threshold voltage;

L: a channel length;

$L_{MN1}$: a channel length of transistor MN1;

$L_{MN2}$: a channel length of transistor MN2;

$L_{MN3}$: a channel length of transistor MN3;

$L_{MN4}$: a channel length of transistor MN4;

$L_{MP1}$: a channel length of transistor MP1;

$L_{MP2}$: a channel length of transistor MP2;

$L_{MP3}$: a channel length of transistor MP3;

W: a channel width;

$W_{MN1}$: a channel width of transistor MN1;

$W_{MN2}$: a channel width of transistor MN2;

$W_{MN3}$: a channel width of transistor MN3;

$W_{MN4}$: a channel width of transistor MN4;

$W_{MP1}$: a channel width of transistor MP1;

$W_{MP2}$: a channel width of transistor MP2;

$W_{MP3}$: a channel width of transistor MP3;

$V_{DD}$: a source voltage;

$V_1$: a bias voltage 1;

$V_2$: a bias voltage 2;

$V_{MN1G}$: a gate voltage of transistor MN1;

$I_1$: circuit current 1;

$I_2$: circuit current 2;

$I_3$: circuit current 3; and $I_4$: circuit current 4.

In the manner as stated above, $V_1$ and $V_2$ are in a relation such that they control each other in FIG. 1. Concretely, the $V_1$ potential starting to rise causes the $V_2$ potential to start to decrease, and the $V_1$ potential starting to decrease causes the $V_2$ potential to start to rise. Therefore, the bias voltage generator circuit has the property of making the circuit current I1 fixed regardless of $V_{DD}$. Because of such property, fixed potentials are generated for $V_1$ and $V_2$, respectively. In other words, even when the source voltage fluctuates, $I_0$ is a constant current and therefore $V_1$ and $V_2$ each produce a fixed potential.

Figure 2:
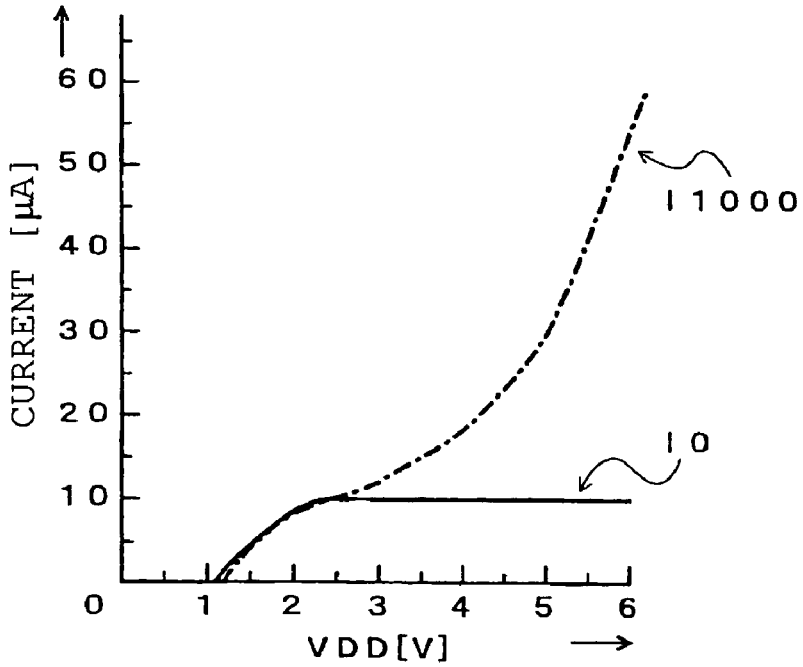
FIG. 2 is a graph showing characteristics of source voltages vs. electric current consumption of bias voltage generator circuits in the first embodiment and a conventional example.
Figure 8:
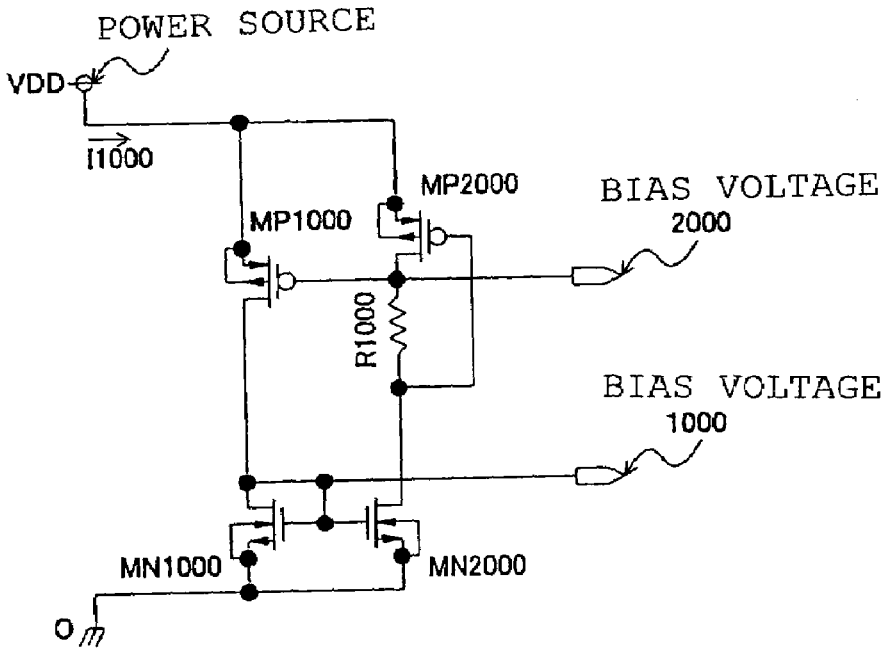
FIG. 8 PRIOR ART
FIG. 8 is a circuit diagram showing the conventional example.

Referring to FIG. 2, there are shown: characteristics of source voltages ($V_{DD}$) vs. electric current consumption (I0) in the above-described bias voltage generator circuit shown in FIG. 1; and characteristics of source voltages ($V_{DD}$) vs. electric current consumption (I1000) in the conventional bias voltage generator circuit shown in FIG. 8. It can be seen from the drawing that the electric current consumption I0 in the bias voltage generator circuit according to the above-described embodiment is kept at a constant value even when $V_{DD}$ is increased.

Figure 3:
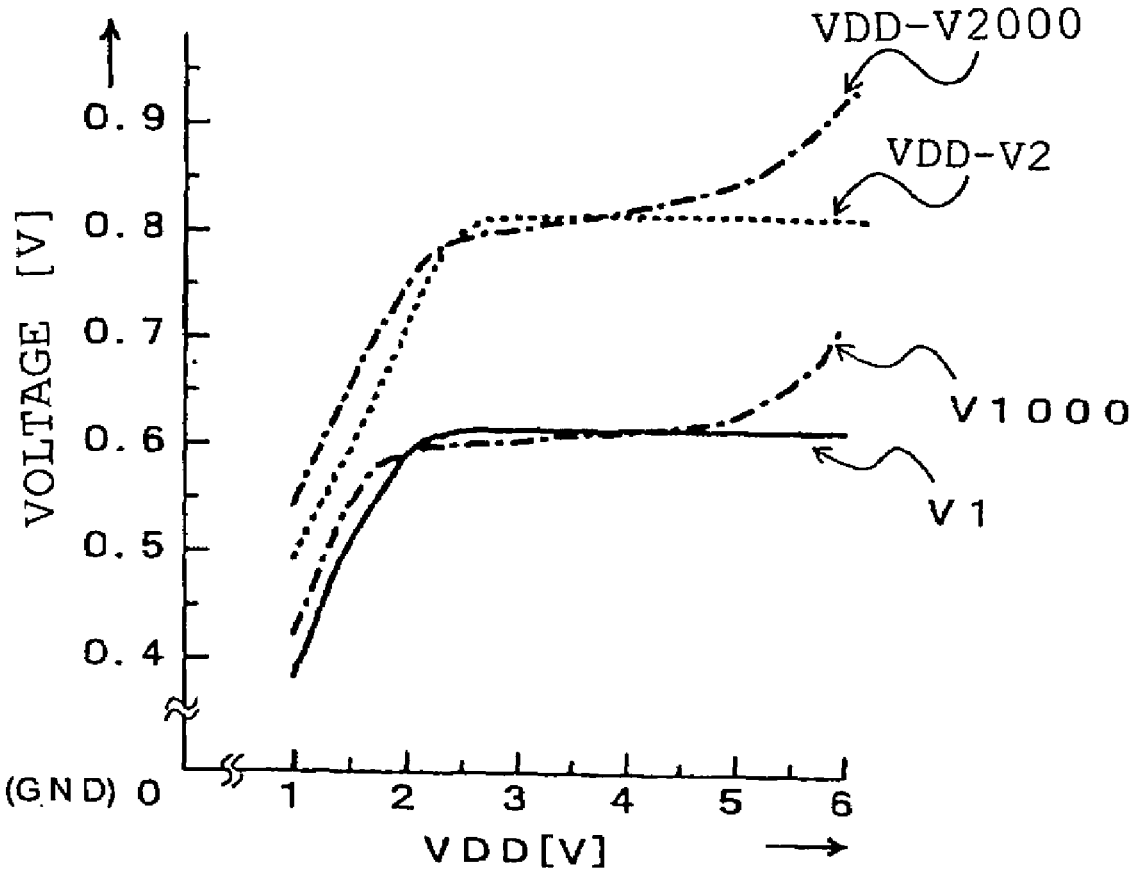
FIG. 3 is a graph showing characteristics of source voltages vs. bias voltage generation in the first embodiment and the conventional example.

Referring now to FIG. 3, there are shown: characteristics of source voltages ($V_{DD}$) vs. bias voltage generation (for $V_1$, $V_{DD}-V_2$) in the above-described bias voltage genera in FIG. 1; and characteristics of source voltages ($V_{DD}$) vs. bias voltage generation (for V1000, $V_{DD}$–V2000) in the conventional bias voltage generator circuit shown in FIG. 8. It can be seen from the drawing that the bias voltages GND+$V_1$ and $V_{DD}-V_2$ in the above-described embodiment are kept at constant values even when $V_{DD}$ is increased.

Figure 4:
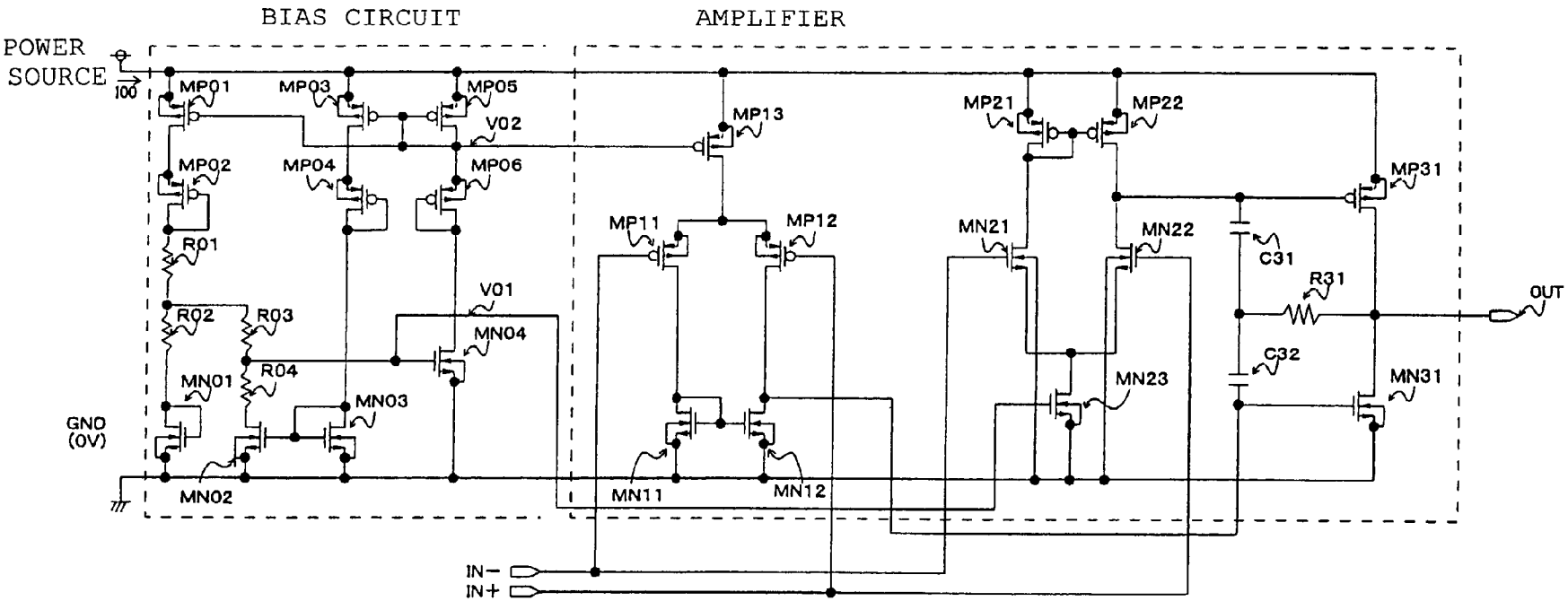
FIG. 4 is a circuit diagram showing an example of a bias voltage generator circuit according to the first embodiment connected with an amplifier.
Figure 5:
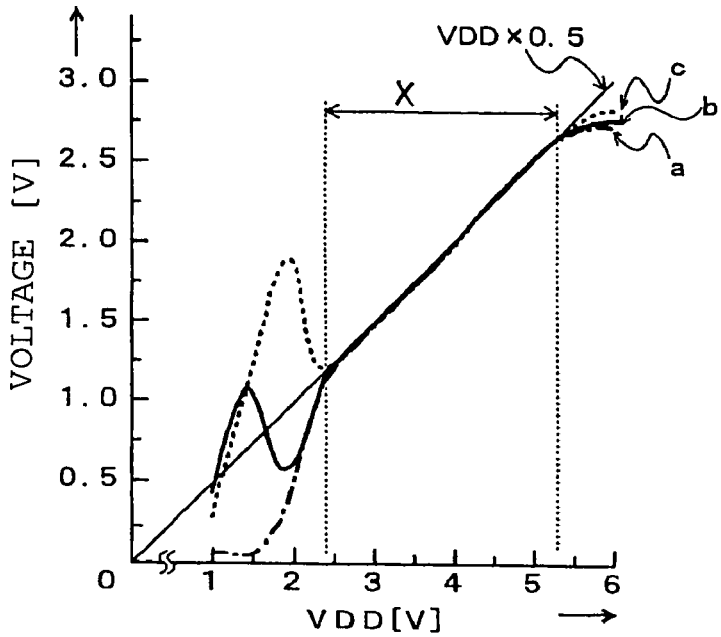
FIG. 5 is a graph showing characteristics of source voltages vs. open loop output voltages in regard to the amplifier connected with the bias voltage generator circuit according to the embodiment.
Figure 6:
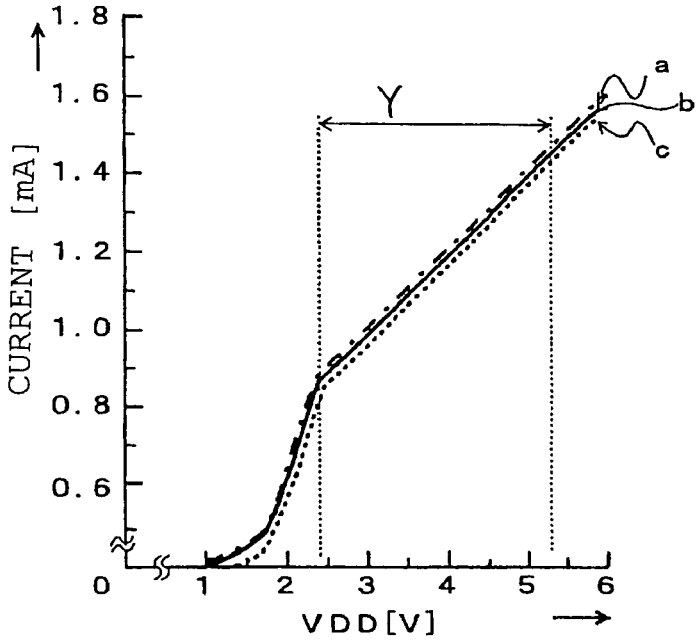
FIG. 6 is a graph showing characteristics of source voltages vs. electric current consumption in regard to the amplifier connected with the bias voltage generator circuit according to the embodiment.

Referring to FIG. 4, there is shown an example of a bias voltage generator circuit according to the embodiment illustrated in FIG. 1, which is connected with a low-saturation type amplifier having a push-pull type power amplifier stage. FIG. 5 shows characteristics of source voltages ($V_{DD}$) vs. open loop output voltages (i.e. potentials at OUT) in the case where a transistor in the amplifier fluctuates in parameter. Likewise, FIG. 6 shows characteristics of source voltages ($V_{DD}$) vs. electric current consumption (I100) in the case where a transistor in the amplifier fluctuates in parameter. In FIGS. 5 and 6, "a" represents the case where Vth's (threshold voltages) of n-channel transistors are relatively low and Vth's of p-channel transistors are relatively high, "b" represents the case where Vth's of the n-channel transistors and p-channel transistors are intended values, and "c" represents the case where Vth's of the n-channel transistors are relatively high and Vth's of the p-channel transistor are relatively low. It can be seen from the drawings that the output offset characteristics and the characteristics of electric current consumption of the amplifier are hard to change even when a transistor fluctuates in parameter. Here, the offset values are fixed in the range X in FIG. 5, and values of electric current consumption are constant in the range Y in FIG. 6.

Figure 7:
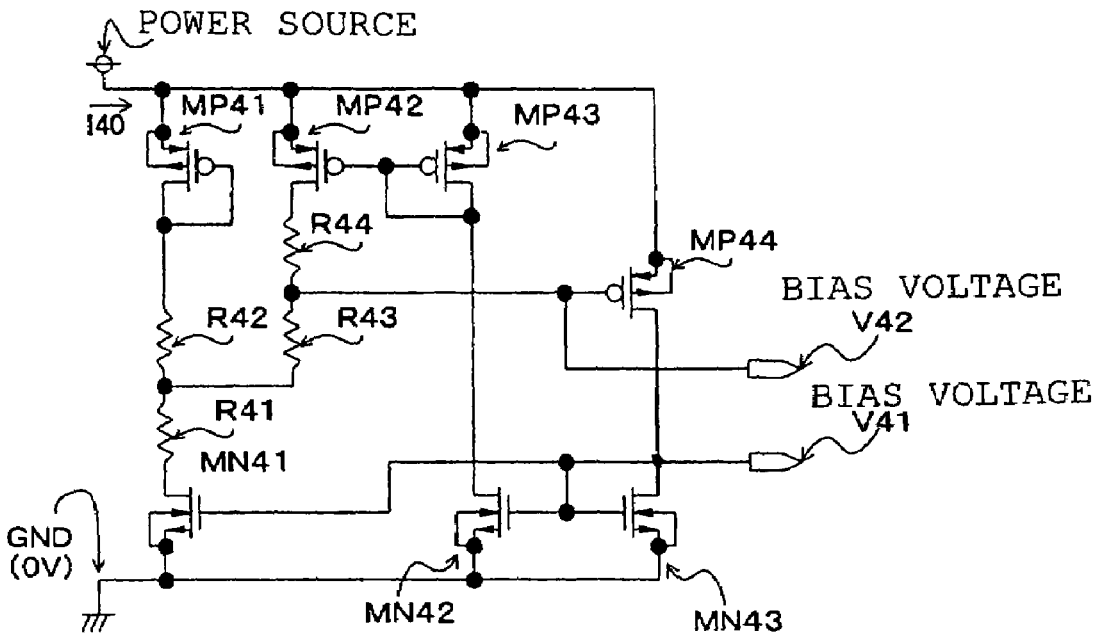
FIG. 7 is a circuit diagram showing an arrangement according to the second embodiment.

Another embodiment of the invention is shown in FIG. 7, wherein the above-described arrangement illustrated in FIG. 1 is adopted, but the p- and n-channel transistors are respectively replaced with reverse conductivity type transistors. More specifically, the bias voltage generator circuit of the embodiment includes: a first n-channel field effect transistor MN41 (hereinafter referred to as transistor MN41) having a source connected to GND and a drain connected to a resistor R41; a second n-channel field effect transistor MN42 (hereinafter referred to as transistor MN42) having a source connected to GND and a gate connected to a gate of the transistor MN41; and a third n-channel field effect transistor MN43 (hereinafter referred to as transistor MN43) having a source connected to GND and a gate and a drain connected to each other, wherein the transistors MN42 and MN41 are connected, in a current mirror, to a potential at a connecting portion of the gate and drain of the transistor MN43.

On the other hand, the bias generator circuit includes: a first p-channel field effect transistor MP41 (hereinafter referred to as transistor MP41) having a source connected to a power source potential and a gate and a drain, both connected through a resistor R42 to one end of the resistor R41 opposite the other end thereof connected to the transistor MN41; a second p-channel field effect transistor MP42 (hereinafter referred to as transistor MP42) having a source connected to the power source potential and a drain connected to a node of the resistors R42 and R41 through resistors R43 and R44 connected in series; a third p-channel field effect transistor MP43 (hereinafter referred to as transistor MP43) having a source connected to the power source potential and a drain and a gate, both connected to a gate of the transistor MP42 and to a drain of the transistor MN42; and a fourth p-channel field effect transistor MP44 (hereinafter referred to as transistor MP44) having a source connected to the power source potential, a gate connected to a node of the resistors R43 and R44, and a drain connected to the drain of the transistor MN43.

The second embodiment can produce the same effects and advantages as those the first embodiment can produce. Thus, the following are made possible: to supply a constant voltage V42 relative to the source voltage from the side of the gate of the transistor MP44 over a wide source voltage range in order to generate a gate-driving voltage for a transistor used for current setting; and to supply a constant voltage V41 relative to GND potential from the side of the drain of the transistor MN43 over a wide source voltage range.

What is claimed is:

1. A bias voltage generator circuit for supplying a constant voltage comprising:

a first p-channel field effect transistor having a source connected to a power source potential and a drain connected to a first resistor;

a second p-channel field effect transistor having a source connected to the power source potential and a gate connected to a gate of said first p-channel field effect transistor;

a third p-channel field effect transistor having a source connected to the power source potential, a gate and a drain connected to the gate;

said first and second p-channel field effect transistors connected, in a current mirror, to a potential at a connecting portion of the gate and drain of said third p-channel field effect transistor;

a first n-channel field effect transistor having a source connected to a ground (GND), a gate, and a drain, the gate and drain connected through a second resistor to one end of the first resistor opposite the other end thereof connected to said first p-channel field effect transistor;

a second n-channel field effect transistor having a source connected to GND and a drain connected to a node of the first and second resistors through third and fourth resistors connected in series;

a third n-channel field effect transistor having a source connected to GND, a drain, and a gate, the drain and gate connected to a gate of said second n-channel field effect transistor and to a drain of said second p-channel field effect transistor; and a fourth n-channel field effect transistor having a source connected to GND, a gate connected to a node of the third and fourth resistors, and a drain connected to the drain of said third p-channel field effect transistor.

2. A bias voltage generator circuit according to claim 1, wherein said drain of third p-channel field effect transistor provides a constant voltage relative to said power source potential for using gate driving-voltage of a field effect transistor used for current setting.

3. A bias voltage generator circuit according to claim 1, wherein said gate of fourth n-channel field effect transistor provides a constant voltage relative to said GND for using gate driving-voltage of a field effect transistor used for current setting.

4. A bias voltage generator circuit for supplying a constant voltage comprising:

a first n-channel field effect transistor having a source connected to GND and a drain connected to a first resistor;

a second n-channel field effect transistor having a source connected to GND and a gate connected to a gate of said first n-channel field effect transistor;

a third n-channel field effect transistor having a source connected to GND, a gate and a drain connected to the gate;

said first and second n-channel field effect transistors connected, in a current mirror, to a potential at a connecting portion of the gate and drain of said third n-channel field effect transistor;

a first p-channel field effect transistor having a source connected to a power source potential, a gate, and a drain, the gate and drain connected through a second resistor to one end of the first resistor opposite the other end thereof connected to said first n-channel field effect transistor;

a second p-channel field effect transistor having a source connected to the power source potential and a drain connected to a node of the first and second resistors through third and fourth resistors connected in series;

a third p-channel field effect transistor having a source connected to the power source potential, a drain, and a gate, the drain and gate connected to a gate of said second p-channel field effect transistor and to a drain of said second n-channel field effect transistor; and a fourth p-channel field effect transistor having a source connected to the power source potential, a gate connected to a node of the third and fourth resistors, and a drain connected to the drain of said third n-channel field effect transistor.

5. A bias voltage generator circuit according to claim 4, wherein said drain of third n-channel field effect transistor provides a constant voltage relative to said GND for using gate driving-voltage of a field effect transistor used for current setting.

6. A bias voltage generator circuit according to claim 4, wherein said gate of fourth p-channel field effect transistor provides a constant voltage relative to said power source potential for using gate driving-voltage of a field effect transistor used for current setting.

* * * * *